United States Patent [19]

Roberts et al.

[11] Patent Number: 4,958,162

[45] Date of Patent: Sep. 18, 1990

[54] NEAR ISOTROPIC CIRCULARLY POLARIZED ANTENNA

[75] Inventors: Thomas E. Roberts, Saratoga; Yeongming Hwang, Los Altos Hill, both of Calif.

[73] Assignee: Ford Aerospace Corporation, Newport Beach, Calif.

[21] Appl. No.: 240,665

[22] Filed: Sep. 6, 1988

[51] Int. Cl.[5] ..... H01Q 1/38; H01Q 21/20

[52] U.S. Cl. ..... 343/700 MS; 343/893

[58] Field of Search ..... 343/700 MS, 890, 891, 343/893, 770, 771

[56] References Cited

U.S. PATENT DOCUMENTS

| | | | |
|---|---|---|---|
| 3,975,733 | 8/1976 | Bogner | 343/891 |
| 4,110,751 | 8/1978 | Reggia et al. | 343/700 MS |
| 4,143,377 | 3/1979 | Salvat et al. | 343/773 |
| 4,162,499 | 7/1979 | Jones et al. | 343/700 MS |
| 4,197,549 | 4/1980 | Collins | 343/771 |
| 4,297,706 | 10/1981 | Nikolayuk | 343/771 |
| 4,323,900 | 4/1982 | Krall et al. | 343/700 MS |
| 4,349,824 | 9/1982 | Harris | 343/700 MS |
| 4,516,097 | 5/1985 | Munson et al. | 343/700 MS |
| 4,527,163 | 7/1985 | Stanton | 343/700 MS |
| 4,605,932 | 8/1986 | Butscher et al. | 343/700 MS |
| 4,612,543 | 9/1986 | DeVries | 342/5 R |

OTHER PUBLICATIONS

Ohmaru et al., "A Switching Antenna for Spin Stabilized Satellites", NHK Tech. Journal, vol. 22, No. 4, 1970, Japan, pp. 11–31.

Galindo, V., Green, K., "A Near-Isotropic Circularly (i) Polarized Antenna for Space Vehicles", *IEEE Transactions on Antennas and Propagation*, vol. AP-13, No. 6, Nov. 1965, pp. 872–877.

Y. T. Lo, S. W. Lee, *Antenna Handbook*, Chapter 21, "Satellite Antennas", by C. C. Han and Y. Hwang, 1988, published by Van Nostrand Reinhold.

*Primary Examiner*—Michael C. Wimer

*Attorney, Agent, or Firm*—Edward J. Radlo; Keith L. Zerschling

[57] ABSTRACT

An antenna for transmitting and/or receiving circularly polarized (CP) electromagnetic radiation throughout a substantial portion of a sphere. A cylindrical waveguide (3,5) is associated with a transmit portion and a receive portion of the antenna, respectively. The outer surface of each waveguide (3,5) is covered with several conductive radiating patches (30,50) equidistant axially and circumferentially arranged. The patches (30,50) may be fed by elongated apertures (51,52) or by coaxial transmission line (41,42). In the former embodiment, CP is present within the waveguide (3,5), while in the latter embodiment, linear polarization is present within the coaxial transmission line (41,42). The individual patches (30,50) radiate CP in a direction normal to the patch (30,50) to produce CP in the broadside direction. The several patches (30,50) arranged in a circularly symmetric fashion working together create, by a process of constructive interference, CP axially, with opposite senses in the forward and reverse directions.

3 Claims, 2 Drawing Sheets

NEAR ISOTROPIC CIRCULARLY POLARIZED ANTENNA

TECHNICAL FIELD

This invention pertains to the field of antennas that can transmit and receive circularly polarized electromagnetic energy in almost all directions. Such antennas are useful as, e.g., telemetry, command, and ranging antennas in spacecraft. The invention has particular applicability at microwave frequencies (those in excess of 1 GHz).

BACKGROUND ART

Galindo, V. et al., "A Near-Isotropic Circulary (sic) Polarized Antenna for Space Vehicles", *IEEE Transactions on Antennas and Propagation,* Vol. AP-13, No. 6, November 1965, pp. 872–877, discloses a near isotropic circular polarization (CP) antenna for spacecraft and the like featuring crossed slot radiators in a cylindrical waveguide, one end of which is sealed by a short circuit. The present invention offers the following advantages over the Galindo device:

1. The radiating means of the present invention (comprising slots, a dielectric, and conductive patches) is mechanically stronger than the Galindo radiating means, which comprises cross slots.

2. The radiating means of the present invention offers more design flexibility than Galindo's cross slots, because the ratio of the dimensions of the patches can be varied; the thickness and dielectric constant of the dielectric can be varied; and the shape and orientation of the slots can be varied. In Galindo, just the shape of the cross slots can be varied.

3. In the present invention, the distance between the short circuit and the radiating means can be varied to improve the impedance match Galindo's device cannot accommodate this technique, because of the requirement for certain currents at the slots.

4. The Galindo device does not show an inner waveguide (e.g., for receive) within an outer waveguide (e.g., for transmit) as in the present invention.

5. The Galindo device does not disclose a reflecting frusto-cone as in the present invention.

U.S. Pat. No. 4,197,549 discloses a slot antenna for UHF broadcasting having a coaxially fed waveguide that generates either linearly or circularly polarized radiation. The reference antenna is suitable for radiating broadside beams but not for endfire beams as required for the instant spacecraft application. The reference uses slot radiators rather than the slot-fed patch radiators of the present invention.

U.S. Pat. No. 4,297,706 also discloses an antenna that is suitable for broadside radiation but not for endfire radiation. In fact, one of the goals of the reference device is to eliminate endfire radiation. The present invention uses patch radiators as opposed to the slot radiators of the reference.

U.S. Pat. No. 4,527,163 discloses yet another antenna which is not designed to radiate endfire (referred to as zero degrees elevation angle in FIGS. 6, 9 and 12). The word "omnidirectional" as used in the reference refers to the azimuthal plane only.

In the reference, CP is generated in the far field by means of a horizontal radiator and a vertical radiator that are fed 90 degrees out of phase. The present invention, on the other hand, generates CP in the far field broadside, via individual patch radiators, and axially, via a pattern of constructive interference.

In the reference, the radiators are fed with linear polarization. In the present invention, the transmit waveguide is fed with CP.

In the reference, the diameter of the cylindrical waveguide is restricted to be about 1/12 of a wavelength. In the present invention, this diameter is about 12 times larger.

A near-isotropic antenna was built by the assignee of the instant patent application and incorporated into the INTELSAT V series of satellites more than one year before the filing date of the instant application. In this antenna, the radiating means comprised slots, not patches as in the present invention. The INTELSAT V antenna produced circular polarization endfire (axially along the cylinder), but linear polarization broadside. The present invention, on the other hand, gets circular polarization both endfire and broadside, because it is a near-isotropic radiator By this is meant that electromagnetic energy surrounding the antenna is circularly polarized over a substantial portion of any sphere having a center positioned at the center of the cylindrical end of the antenna.

A similar slotted-cylinder reflector antenna using a reflecting cone is described in Y.T. Lo and S.W. Lee, *Antenna Handbook,* Chapter 21 "Satellite Antennas," by C.C. Han and Y. Hwang (published in 1988 by Van Nostrand Reinhold). Like the Intelsat V antenna, this antenna does not have radiating patches; and linear polarization is generated broadside, CP axially.

DISCLOSURE OF INVENTION

The present invention is an antenna adapted for transmitting and/or receiving circularly polarized (CP) electromagnetic energy. The antenna comprises an elongated hollow electrically conductive cylinder (3,5) closed at one end thereof by a short circuiting electrically conductive wall (25,23). Circularly polarized electromagnetic energy is present within the cylinder (3,5). Positioned circumferentially around an outer surface of the cylinder (3,5) at substantially the same axial distance therealong are several electrically conductive radiating patches (30,50) each having a curvature that conforms to the curvature of said outer surface. A dielectric layer (32,52) is juxtaposed between the patches (30,50) and said outer surface for providing electrical insulation therebetween. Coupling means (31,51) situated along said outer surface beneath each patch (30,50) couple electromagnetic energy within the cylinder (3,5) to regions outside the cylinder (3,5). Electromagnetic energy outside the cylinder (3,5) forms a constructive radiation pattern via interaction between the patches (30,50) and coupling means (31,51), so that the electromagnetic energy surrounding the cylinder (3,5) is circularly polarized over a substantial portion of any sphere having a center positioned at the center of said end (25,23).

BRIEF DESCRIPTION OF THE DRAWINGS

These and other more detailed and specific objects and features of the present invention are more fully disclosed in the following specification, reference being had to the accompanying drawings, in which.

BEST MODE FOR CARRYING OUT THE INVENTION

Figure 1:
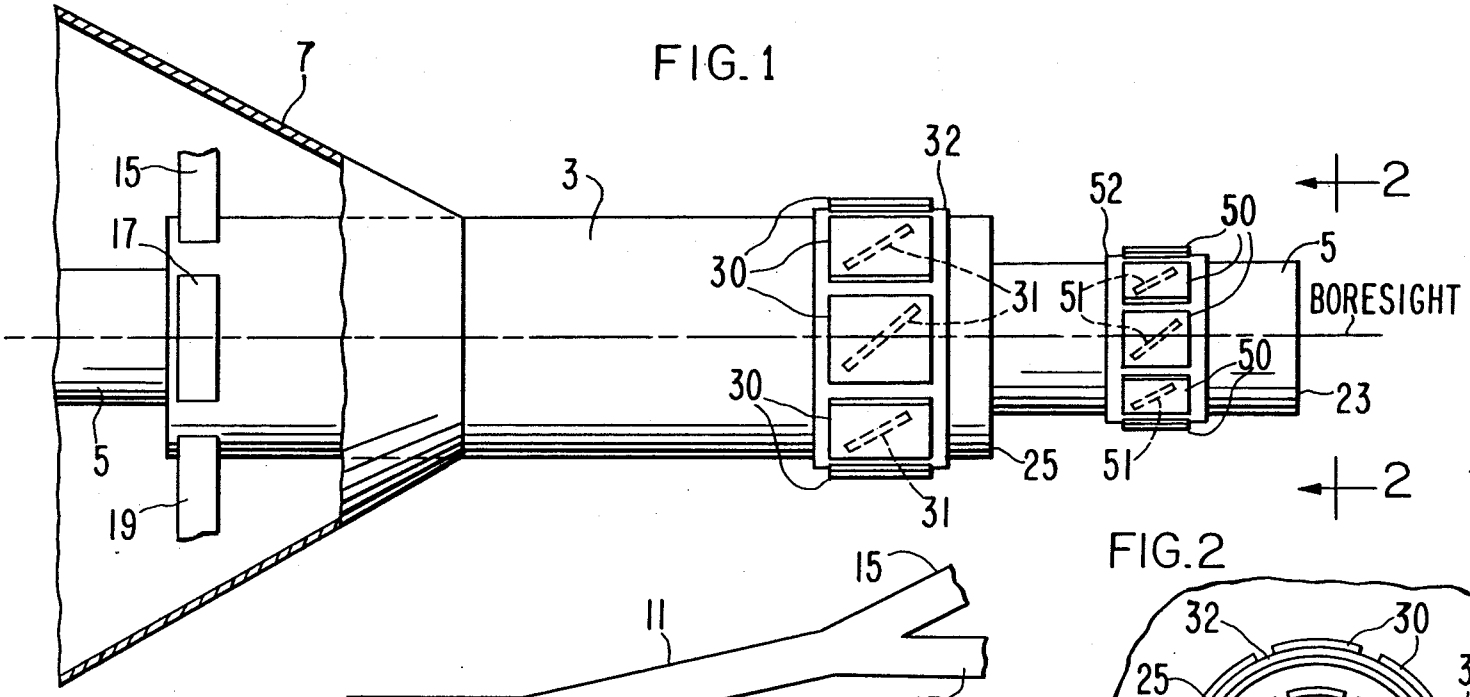
FIG. 1 is a side view, partially broken away, of an embodiment of the present invention using two coaxial cylinders 3,5.
Figure 2:
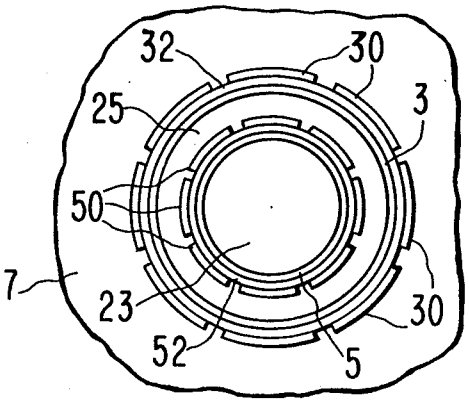
FIG. 2 is an end view of the embodiment depicted in FIG. 1.

An ideal spacecraft antenna for telemetry, command and ranging (TC&R) would provide nearly isotropic angular coverage with circular polarization (CP). CP is good for communicating with tumbling spacecraft, e.g., when the spacecraft is in its transfer orbit. It is desirable for the antenna to have maximum gain and minimum cross-polarization over a plus/minus 135° cone whose midline is coincident with the boresight of the antenna.

The invention described herein satisfies the above objectives.

The embodiment depicted in FIGS. 1–4 comprises two coaxial elongated electrically conductive hollow cylindrical waveguide structures 3,5. Waveguide 3 is used for transmit and waveguide 5 is used for receive. However, it must be understood that the principles of the invention can be used with a single waveguide, or with more than two coaxial waveguides. Although the receive portion of the antenna could be associated with the larger waveguide 3, normally the larger waveguide 3 is used for transmit because we want the transmit link to be at a lower frequency. This is due to the fact that transmit power in a spacecraft is limited, and atmospheric attenuation is lower at the lower frequency. The components of the transmit and receive waveguides 3,5 are usually frequency scaled with respect to each other. The transmit antenna could be completely separate from the receive antenna, but combining the two as shown herein is desirable because space on a spacecraft is also limited.

The axial radiation generated by the ring of patches 30,50 arranged in a circularly symmetrical fashion at the same axial position radiates CP along the boresight with opposite senses in the forward and reverse directions. Individual patches 30,50 generate CP in the broadside direction.

Conductive radiating patches 30,50 are fed by slots 31,51, respectively, in the waveguide 3,5, respectively. The radiating patches 30,50 provide additional design freedom compared with prior art devices as in Galindo, supra, in that the shape and size of the patches 30,50 can be adjusted to improve the CP axial ratio and the radiation pattern separately from the waveguide coupling, which is controlled by the size and shape of the slots 31,51. This permits better optimization of radiation patterns, better CP quality, and a smaller reflection coefficient.

Several patches 30,50 are equidistant axially along the circumference of the corresponding waveguide 3,5. The patches 30,50 have a curvature which fits the curvature of the associated outer surface of the waveguide 3,5. The patches 30,50 are dimensioned so that radiation normal to the patch 30,50 is CP. The transmit waveguide 3 is excited with CP, resulting in CP being radiated along the boresight of the antenna and throughout a large cone centered thereon. The radiation follows a substantially cardiod pattern when viewed from the side as in FIG. 1. In the embodiments (FIGS. 1, 2, 4, 5) where the patches 30,50 are rectangular, the long sides of the rectangles are generally aligned axially with the cylindrical waveguide 3,5. However, a patch 30,50 can be rotated slightly off-axis so that the amplitudes of the two components of the CP emanating therefrom are equalized.

In the embodiments depicted in FIGS. 1, 2, 4, and 6, one patch 30,50 covers one corresponding coupling aperture (slot) 31,51. Each coupling (excitation) slot 31,51 is typically about 0.4 wavelength long at the center frequency and about 0.1 wavelength wide. The exact dimensions of the slot 31,51 are experimentally determined for impedence matching purposes.

The conductive patches 30,50 are insulated from the conductive outer surfaces of the corresponding waveguides 3,5 by dielectric layers 32,52. Dielectrics 32,52 can be made of any one of a number of substances such as PTFE (polytetrafluouroethylene) A suitable dielectric constant is 2.3 for both transmit and receive. The combination of dielectric 32,52 plus patches 30,50 can be fabricated from a copper-cladded dielectric; the copper is etched away using a mask to form copper radiating patches 30,50 in the proper shape and orientation.

In the FIGS. 1, 2, 4, and 5 embodiments, each radiating patch 30,50 has the shape of a rectangle that is nearly but not exactly a square. A first dimension L1 (see FIG. 4) is slightly greater than a second orthogonal dimension L2. A starting dimension for each side of the rectangle is one-half of the wavelength of the electromagnetic energy present, taking into account the presence of the dielectric layer 32,52 and the presence of the medium on the radiating side of the antenna (vacuum in the spacecraft application). The starting dimension is slightly increased to give L1 and slightly decreased to give L2. The slight increase is equivalent to a slight frequency detune in the inductive direction. The slight decrease is equivalent to a slight frequency detune in the capacitive direction.

Each slot 31,51 forms substantially a 45° angle with respect to the four sides of its associated radiating patch 30,50, viewed from the perspective of the planar projection of said patch 30,50. The angle between the slot 31,51 and the relatively long side of the corresponding patch 30,50 is slightly less than 45°, while the angle between the slot 31,51 and the relatively short side of the corresponding patch 30,50 is slightly greater than 45°. The angle may be adjusted slightly in order to equalize the amplitudes of the two orthogonal components of the CP emanating from the patch 30,50. This enhances the quality of the CP in the broadside direction.

The ratio between L1 and L2, and the dimensions of the slot 31,51, can be adjusted to keep the phase differential between the two components of CP at 90°. The circularly polarized bandwidth can be fine tuned by adjusting the thickness of the dielectric layers 32,52, the dimensions of the slots 31,51, and/or the dielectric constant of the dielectric layers 32,52.

Figure 6:
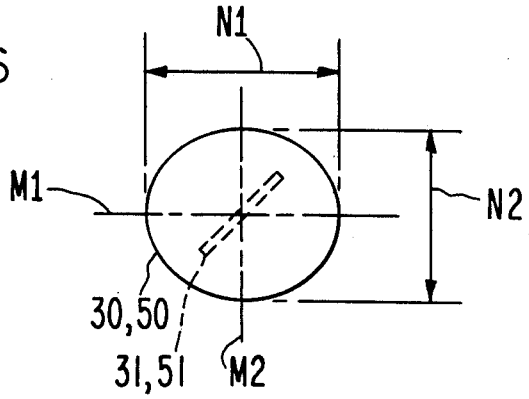
FIG. 6 is a plan view of a third embodiment of radiating means that can be used in the present invention.

An alternative embodiment is depicted in FIG. 6 in which the shape of each radiating patch 30,50 is elliptical rather than near-square. N1, the dimension of patch 30,50 along major axis M1 of the ellipse, is slightly greater than N2, the dimension of patch 30,50 along the orthogonal minor axis M2 of the ellipse. In this embodiment, the slot 31,51 makes approximately a 45° angle to each of major axis M1 and minor axis M2.

The use of patches 30,50 in combination with the dielectric layer 32,52 enables the realization of a better impedence match for a given bandwidth, or a broader bandwidth for a given impedence, compared with prior art antennas in which the radiating layer and feed are coplanar. This is because the combination of the patch 30,50 and the dielectric 32,52 acts as a load, lowering the Q. The tradeoff is slightly greater loss.

The CP leaving the left (in FIG. 1) end of receive antenna 5 can be converted to linear polarization by any conventional means, e.g., a septum polarizer. Transmit antenna 3 is similar to receive antenna 5 except for a more complex feed arrangement. The illustrated transmit antenna 3 is fed from a coaxial line operating in the $TE_{11}$ mode with circular polarization. The transmit coaxial line has a large inner conductor, permitting the receive waveguide 5 to pass therethrough. The outer surface of receive waveguide 5 can act as the inner conductor of the transmit coaxial line. In addition to the desired $TE_{11}$ mode, the coaxial line can support the TEM mode and the $TE_{21}$ mode. The diameter of waveguide 3 is small enough to cut off the other higher order modes. In general, it is desirable for the diameters of the waveguides 3,5 to be as small as possible to avoid multimoding. However, these diameters must be sufficiently large to accommodate the several patches 30,50.

Figure 3:
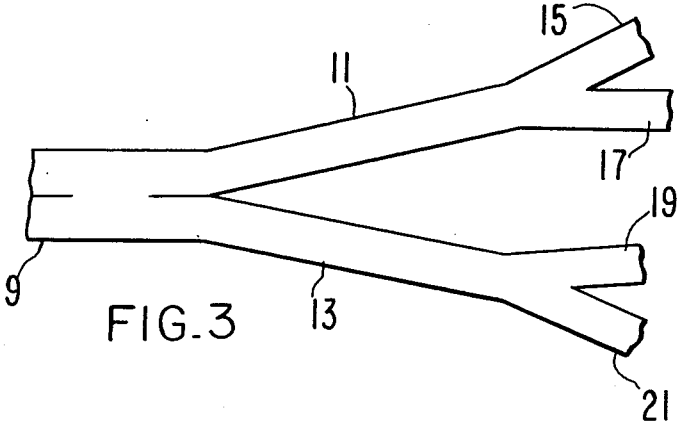
FIG. 3 is one example of a feeding means that can be used with cylinder 3 depicted in FIG. 1.
Figure 4:
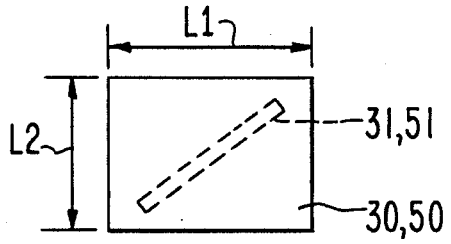
FIG. 4 is a plan view of a first embodiment of radiating means that can be used in the present invention.

A suitable waveguide feed for the transmit coaxial line consists of a sidewall coupler 9 and two E-plane splitters 11,13 as illustrated in FIG. 3. These components are embodied in rectangular waveguide. By this technique, the linear polarized energy within waveguide sections 15, 17, 19, and 21 are progressively 90° out of phase with respect to each other. These four waveguide outputs 15,17,19,21 are coupled to the coaxial line at points that are physically 90° apart circumferentially around waveguide 3 (see FIG. 1). The symmetry is such that the two undesired higher-order modes are not excited.

By this technique, a system of constructive interference is set up along the axial direction and CP is generated. Since the CP in the forward axial direction has the opposite sense (i.e., right hand CP v. left hand CP or left hand CP v. right hand CP) to that in the backward axial direction, a frustocone 7 having its center axis aligned along the common boresight of antennas 3,5 is positioned around the larger waveguide 3 to reflect the energy in the backward axial direction into the coverage region. Such reflection reverses the CP sense so that all of the radiation in the forward axial direction is desirably of the same sense. The angle between frustocone 7 and the outer surface of waveguide 3 can be adjusted experimentally for optimum pattern shaping, but 45° has proven to be a good angle. With the 45° angle, 270° coverage area of CP is achieved. Frustocone 7 plays the additional important role of keeping radiation away from components onboard the spacecraft.

Generally speaking, it is desirable for there to be as many patch radiators 30,50 as possible, to give as smooth a coverage as possible. However, a limited number of patches 30,50 can be fit on the cylindrical waveguide surface due to geometrical constraints. Eight has been shown to be an adequate number of patches 30,50 to provide an acceptable ripple for the pattern.

The following two tables give suitable dimensions for the receive waveguide 5 and the transmit wave guide 3, respectively:

TABLE 1

| RECEIVE WAVEGUIDE 5 KEY DIMENSIONS (Wavelengths) | |
|---|---|
| Diameter | 0.95 |
| $TE_{11}$ cut-off wavelength | 0.616 |
| $TE_{11}$ guide wavelength | 0.787 |
| Outer circumference | 2.98 |
| Outer circumference/8 | 0.373 |
| Slot length | 0.4 |
| Slot length × sin(45°) | 0.287 |
| Patch size | 0.3 × 0.36 |

TABLE 2

| TRANSMIT WAVEGUIDE 3 KEY DIMENSIONS (Wavelengths) | |
|---|---|
| Outer diameter | 1.0 |
| Inner diameter | 0.7 |
| $TE_{11}$ cut-off wavelength | 0.3638 |
| $TE_{11}$ guide wavelength | 0.9315 |
| Outer circumference | 3.14 |
| Outer circumference/8 | 0.3932 |
| Slot length | 0.4 |
| Slot length × sin (45°) | 0.287 |
| Patch size | 0.3 × 0.36 |

Each wave guide 3,5 is closed at its forward end by an electrically conductive short circuiting wall 25,23, respectively. Wall 25 has the shape of an annulus. This generates a standing wave within the corresponding waveguide 3,5. The distance between the wall 25,23 and the corresponding ring of patches 30,50 can be adjusted experimentally for impedance matching purposes.

Figure 5:
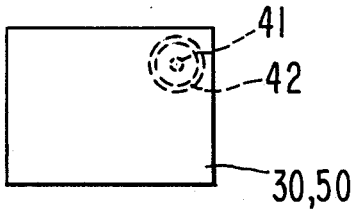
FIG. 5 is a plan view of a second embodiment of radiating means that can be used in the present invention.

An alternative embodiment for exciting the patches 30,50 is depicted in FIG. 5, wherein a coaxial transmission line, comprising center conductor 41 and coaxial outer conductor 42, is associated with each patch 30,50. In this embodiment, an end of the coaxial transmission line 41,42 terminates at the dielectric layer 32,52 orthogonally thereto. The center conductor 41 is offset from the center of the patch 30,50, in order to get circular polarization. In this embodiment, the coaxial transmission line 41,42 is fed with linear polarization.

FIG. 1 shows the transmit and receive slots 31,51 all being parallel, assuming the circumference of the corresponding waveguide 3,5 is rolled out and flattened. Thus, the transmit and receive antennas have the same sense of polarization. This is often a convenient condition (e.g., for processing by ground stations), but is not a necessary one. If the slots 31,51 are rotated 90° and the phasing of the feed is reversed, the opposite sense of polarization is obtained.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. An antenna adapted for circularly polarized electromagnetic energy, comprising:

a first hollow, electrically conductive cylinder elongated along a cylindrical axis and closed at one end thereof by a short circuiting electrically conductive wall, wherein circularly polarized electromagnetic energy propagates within said cylinder;

positioned, generally equispaced circumferentially, around an outer surface of the cylinder at substantially the same axial distance therealong, a plurality of electrically conductive radiating patches each having a curvature that conforms to the curvature of said outer surface;

a dielectric layer juxtaposed between said patches and said outer surface for providing electrical insulation therebetween; and coupling means situated along said outer surface beneath each patch for coupling electromagnetic energy within the cylinder to each patch and to regions outside the cylinder; wherein electromagnetic energy outside the cylinder forms a constructive radiation pattern via interaction between the patches and coupling means, so that electromagnetic energy surrounding the cylinder is circularly polarized over a substantial portion of any sphere having a center positioned at the center of said end;

the coupling means comprises an elongated narrow aperture associated with each patch;

each patch has the shape of a rectangular near square; and the long axis of each aperture makes nearly a 45° angle with respect to each side of its associated near square rectangular patch.

2. An antenna adapted for circularly polarized electromagnetic energy, comprising:

a first hollow, electrically conductive cylinder elongated along a cylindrical axis and closed at one end thereof by a short circuiting electrically conductive wall, wherein circularly polarized electromagnetic energy propagates within said cylinder;

positioned, generally equispaced circumferentially, around an outer surface of the cylinder at substantially the same axial distance therealong, a plurality of electrically conductive radiating patches each having a curvature that conforms to the curvature of said outer surface;

a dielectric layer juxtaposed between said patches and said outer surface for providing electrical insulation therebetween; and coupling means situated along said outer surface beneath each patch for coupling electromagnetic energy within the cylinder to each patch and to regions outside the cylinder; wherein electromagnetic energy outside the cylinder forms a constructive radiation pattern via interaction between the patches and coupling means, so that electromagnetic energy surrounding the cylinder is circularly polarized over a substantial portion of any sphere having a center positioned at the center of said end;

the coupling means comprises an elongated narrow aperture associated with each patch;

each patch has the shape of a nearly circular ellipse having a major axis and a minor axis; and the long axis of each aperture makes a 45° angle with respect to each of the major and minor axes of its associated elliptical patch.

3. An antenna adapted for circularly polarized electromagnetic energy, comprising:

a first hollow, electrically conductive cylinder elongated along a cylindrical axis and closed at one end thereof by a short circuiting electrically conductive wall, wherein circularly polarized electromagnetic energy propagates within said cylinder;

positioned, generally equispaced circumferentially, around an outer surface of the cylinder at substantially the same axial distance therealong, a plurality of electrically conductive radiating patches each having a curvature that conforms to the curvature of said outer surface;

a dielectric layer juxtaposed between said patches and said outer surface for providing electrical insulation therebetween; and coupling means situated along said outer surface beneath each patch for coupling electromagnetic energy within the cylinder to each patch and to regions outside the cylinder; wherein electromagnetic energy outside the cylinder forms a constructive radiation pattern via interaction between the patches and coupling means, so that electromagnetic energy surrounding the cylinder is circularly polarized over a substantial portion of any sphere having a center positioned at the center of said end;

said antenna further comprising a second cylinder whose dimensions are frequency scaled with respect to the first cylinder, where:

the first cylinder is fitted coaxially within and protrudes from the second cylinder;

the second cylinder is elongated and hollow;

a short circuiting electrically conducting annulus connects a first end of the second cylinder to the outside electrically conductive surface of the first cylinder;

circularly polarized electromagnetic energy is present within the second cylinder;

positioned, generally equispaced circumferentially, around an outer surface of the second cylinder at substantially the same axial distance therealong, are a plurality of electrically conductive radiating patches each having a curvature that conforms to the curvature of said outer surface of said second cylinder; and one of said cylinders is used for transmitting and the other of said cylinders is used for receiving.

* * * * *